United States Patent [19]

Crepinsek

[11] 4,027,908

[45] June 7, 1977

[54] SAFETY CHAIN LOCK FOR DOORS

[75] Inventor: Alois Crepinsek, El Paso, Tex.

[73] Assignee: International Top Security Corporation, El Paso, Tex.

[22] Filed: July 25, 1975

[21] Appl. No.: 599,093

[52] U.S. Cl. ..... 292/264; 70/93
[51] Int. Cl.[2] ..... E05C 17/36
[58] Field of Search ..... 70/93, 89, 461, 450, 70/451; 292/264, 341.18

[56] References Cited

UNITED STATES PATENTS

| | | | |
|---|---|---|---|
| 1,924,627 | 8/1933 | Segal | 70/93 |
| 2,724,257 | 11/1955 | Segal | 292/264 |
| 2,726,112 | 12/1955 | Conhagen | 292/264 |
| 3,660,997 | 5/1972 | Michnoff | 70/93 |

FOREIGN PATENTS OR APPLICATIONS

| | | | |
|---|---|---|---|
| 718,626 | 9/1965 | Canada | 70/93 |
| 709,801 | 8/1941 | Germany | 70/93 |
| 688,749 | 3/1953 | United Kingdom | 292/341.18 |

*Primary Examiner*—Paul R. Gilliam
*Assistant Examiner*—Kenneth J. Dorner
*Attorney, Agent, or Firm*—D. Paul Weaver

[57] ABSTRACT

A chain lock for doors is greatly reinforced by the placement of a first chain end anchor behind an angle retainer which embraces a square corner of the adjacent door frame and is further secured by a serrated clamping plate in a plane perpendicular to the first chain end anchor. The opposite chain end anchor is received in a slot of a retainer plate which similarly embraces a corner of the swinging door and is further held securely by an extension which is locked to an adjacent interior portion of a door lock cylinder housing assembly.

4 Claims, 5 Drawing Figures

FIG. 1
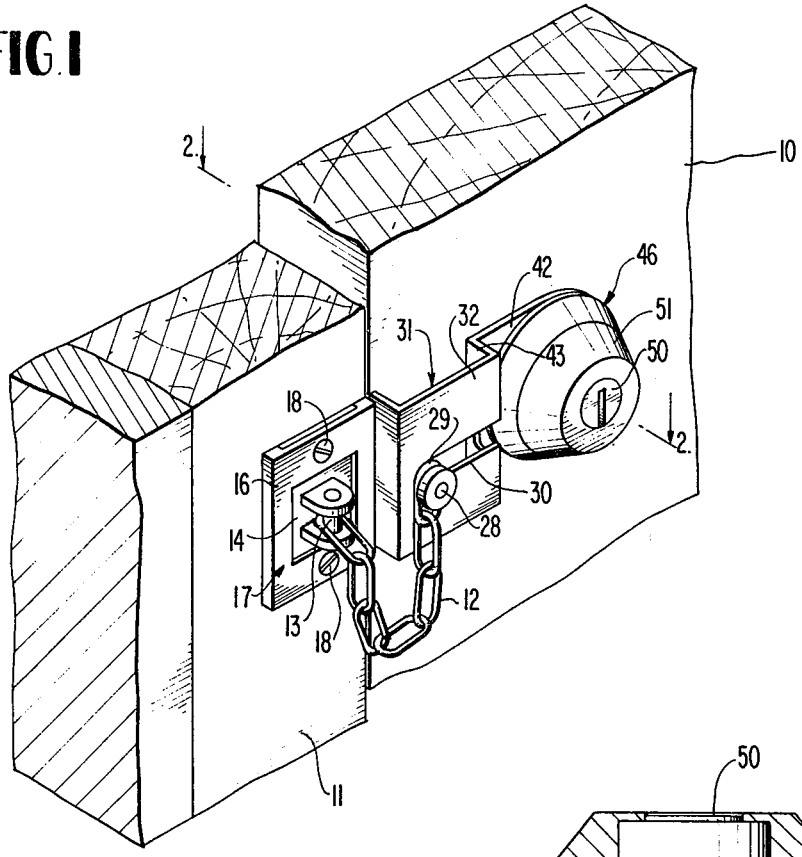
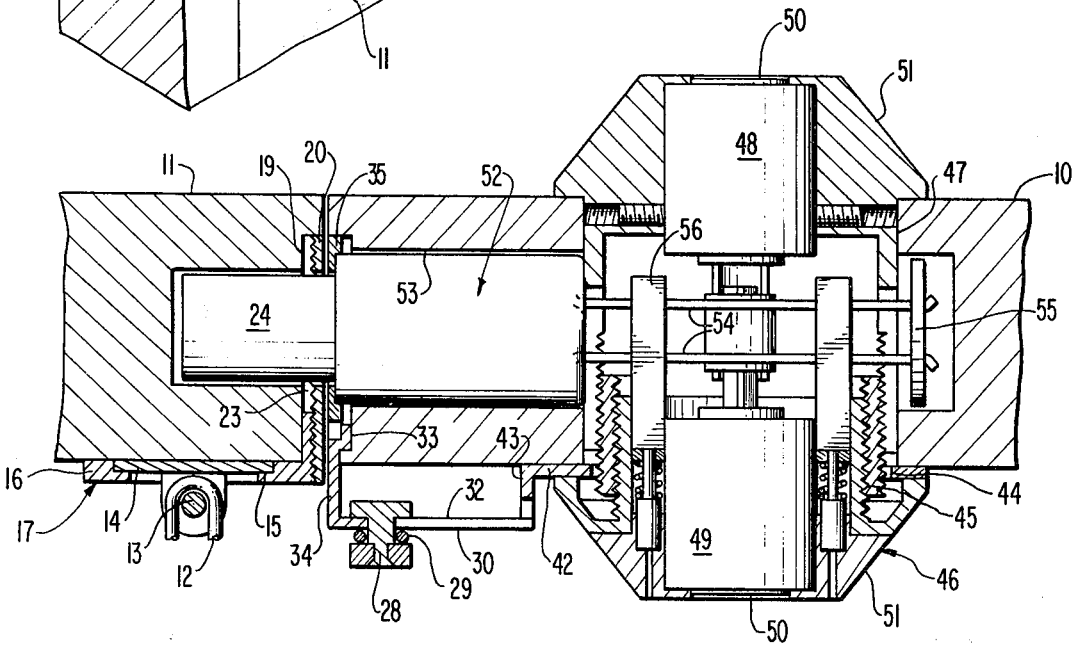
FIG. 2

FIG. 3
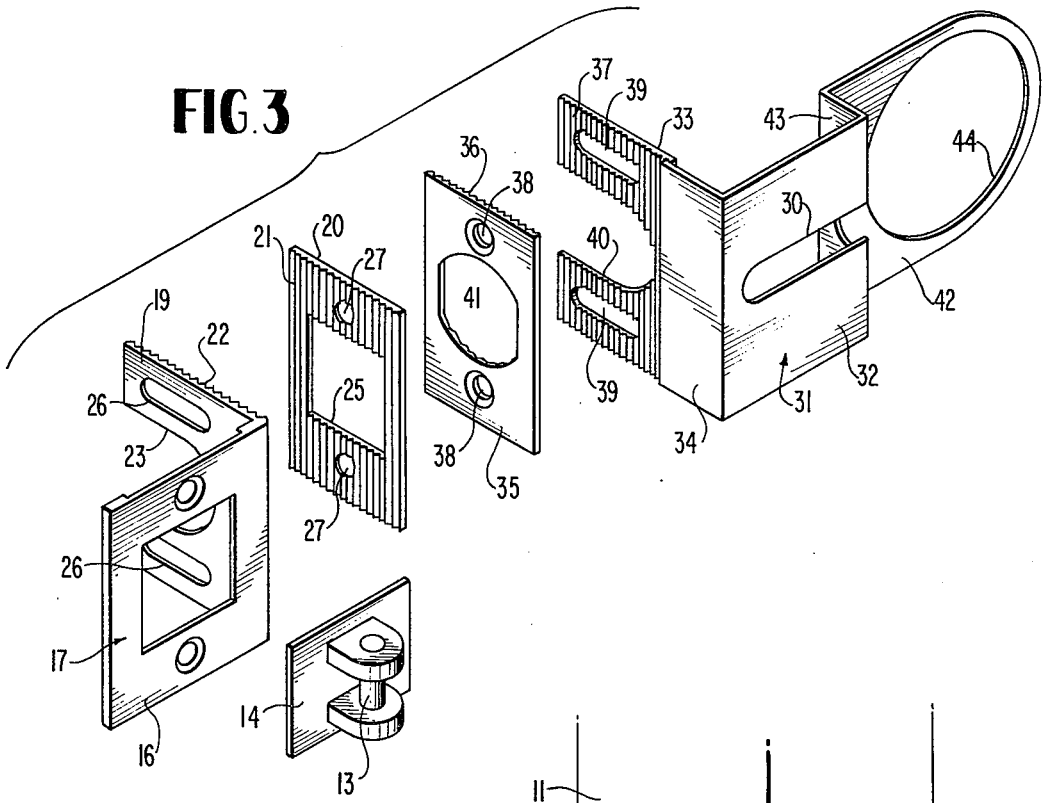
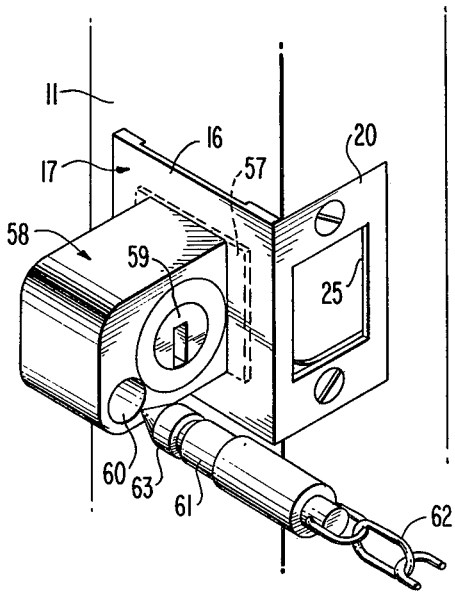
FIG. 5
FIG. 4
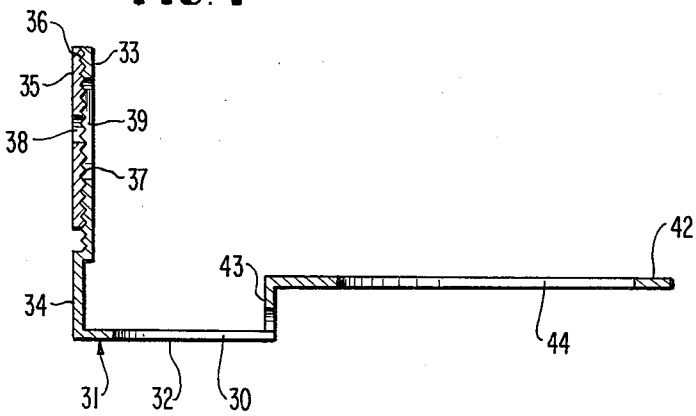

SAFETY CHAIN LOCK FOR DOORS

BACKGROUND OF THE INVENTION

Safety chain locks of the kind commonly employed on the doors of homes and apartments are relatively ineffective for the simple reason that the usual chain end anchor elements are held very insecurely by a pair of retainers on the interior side of the door and on the corresponding side of the adjacent door frame. These retainers are usually fastened to the door and door frame by two or more wood screws, with the result that a shoulder of an intruder placed firmly against the door can easily rip one or both of the screw anchored retainer elements from the door or frame. Only in cases where metal doors and door frames are employed can these customary prior art structures have even minimal security.

Consequently, there is a distinct need in the art for improved safety chain locks for doors, and it is the object of this invention to completely satisfy this need in a practical and economic way by providing an improved and much more secure mounting means for chain end anchors, whereby the lock can readily withstand the forces of an intruder even when installed on a wooden door and door frame. More particularly, one chain end anchor is secured to the interior face of the door frame by an L-shaped or angle retainer which embraces the interior corner of the frame in two right angular planes. The web of this retainer which receives the adjacent door lock bolt is serrated and tightly clamped to the frame by an overlying serrated clamp plate which also receives the door lock bolt.

The opposite chain end anchor is removably engaged in a heavy slotted retainer plate which is similarly clamped to the edge of the door through which the lock bolt projects. An interior extension of the retainer plate is engaged over the interior portion of the door lock housing assembly which is immovable and unseparable from the outer assembly portion except when the door is open to expose the dead bolt. In this manner, the retainer plate for the adjustable or separable chain end anchor is doubly reinforced at its ends and very firmly secured to the door lock housing assembly. As a consequence, it is virtually impossible to dislodge the chain anchor retainers from their moorings on the door frame and door.

The invention while illustrated in association with a certain preferred form of door lock mechanism is equally adaptable to a variety of doors and door lock mechanisms.

Other features and advantages of the invention will become apparent during the course of the following description.

BRIEF DESCRIPTION OF DRAWING FIGURES

FIG. 1 is a perspective view of a chain lock for doors according to the invention.

FIG. 2 is a horizontal section on an enlarged scale taken on line 2—2 of FIG. 1, with parts broken away and parts in elevation.

FIG. 3 is an exploded perspective view of elements embodied in the chain lock.

FIG. 4 is a horizontal cross section taken through the chain anchor retainer plate and associated serrated clamping plate.

FIG. 5 is a perspective view showing a modification of the invention.

DETAILED DESCRIPTION

Referring to the drawings in detail, wherein like numerals designate like parts, the numerals 10 and 11 denote a door and a cooperating door frame of conventional construction. In the usual manner, the safety chain lock embodying the invention is applied to the interior of the door as depicted in FIG. 1 to resist an intruder attempting to enter from the outside. The chain lock comprises a suitable length of chain 12 or an equivalent high strength flexible element. A first chain end anchor 13 secured to one end link includes a flat anchor plate 14 received in a shallow recess 15 in the rear face of one web 16 of an L-shaped or angled retainer 17. The web 16 lying on the inner face of the frame 11 is anchored to the frame by a pair of screws 18 above and below the anchor plate 14.

The retainer 17 has a right angular web 19 which laps the adjacent edge of the door frame forming the doorway opening. The frame may be mortised as shown in FIG. 2 to receive the web 19 as well as an overlying rectangular clamp plate 20 having one serrated face 21 to interlock with an opposing serrated face 22 of the retainer web 19. The web 19 has a large central slot 23 to receive the door lock dead bolt 24 and the clamp plate 20 has a central opening 25 for the same purpose. The web 19 has horizontal slots 26 near its top and bottom registering with apertures 27 in the clamp plate 20 when the parts are assembled. Additional screws, not shown, extend through apertures 27 and slots 26 to anchor the angle retainer 17 firmly to the bolt receiving edge of the door frame 11. The slots 26 render the retainer 17 adjustable. The clamping effect of the serrated plate 20 on the retainer web 19 renders the retainer very difficult to dislodge from the door frame by an intruder.

The chain lock further comprises an adjustable and detachable chain end anchor 28 or slide pin secured permanently to the other end link 29 of the chain 12. The shank of slide pin 28 is received removably in a horizontal retaining slot 30 of a chain anchor retainer plate 31 forming a key element of the invention. The wall of the retainer plate 31 adjacent to the slot 30 is offset inwardly at 32 relative to the interior face of the door 10. A right angular web or plate portion 33 of retainer plate 31 laps the adjacent free edge of the door 10 and is received in a shallow mortised recess in the door edge as shown in FIG. 2. A short offset extension 34 of the retainer plate projects inwardly of the door and is joined to the web 32 in integral right angular relationship.

A rectangular clamp plate 35 similar to the plate 20 and having one serrated face 36 engages an opposing serrated face 37 of web 33 when the parts are assembled. Clamping screws, not shown, are received through apertures 38 and adjusting slots 39 of the clamp plate 35 and web 33, respectively, and for the same purposes discussed in connection with elements 19 and 20. The web 33 also has a central bolt clearance slot 40 formed therethrough and the plate 35 has a bolt receiving opening 41. Thus, the retainer plate 31 embraces the interior square corner of the door 10 similarly to the described engagement of the retainer 17 with the interior corner of the frame 11. Both retainers are very tightly held to the opposing edges of the door and door frame to resist intruders.

The retainer plate 31 has an additional security feature in the form of an interior longitudinal plate extension 42 connected with the wall 32 by a short right angular web 43. The aforementioned slot 30 opens through the web 43, as shown. The plate extension 42 which is flat lies directly against the interior face of door 10 and has a large circular opening 44 receiving the adjacent interior element 45 of a door lock cylinder housing assembly 46 installed in a through bore 47 of the door 10.

While the chain lock mechanism may be utilized with many forms of doors and door locks, it is illustrated herein in association with a certain improved dead bolt lock for doors which in and of itself is very secure and resistant to intruders. This lock per se forms no direct part of the present invention and accordingly will not be fully described. Very briefly, the lock has exterior and interior key operated cylinder units 48 and 49 each having a rotary tumbler plug 50. Thus a key is required to open the door from the outside or inside. No manual door knobs or handles are employed. The inner and outer extremities of the lock cylinder housing 46 are defined by smooth conically tapered heads 51 which resist tampering and prying. The exterior and interior components of the housing 46 are coupled by screw threads within the confines of the door and the assembly 46 can only be taken apart or separated when the door is open.

In this connection, a dead bolt assembly 52 containing the reciprocating bolt 24 is utilized and mounted in a cross bore 53 in the edge of the door 10 which intersects the door bore 47. Plate elements 54 of the dead bolt assembly 52 bridge the assembly 46 and the bore 47 and are anchored as at 55 within the door 10, whereby the bolt assembly 52 prevents relative rotation and separation of the outer and inner components of the lock cylinder housing 46, except when the door is open.

When the door is open to expose the bolt 24, a release plunger means, not shown, within the bolt is depressed to release a latch means, not shown, in turn releasing a catch element 56, whose release allows separation or disassembly of the housing 46. A further description of the door lock mechanism is unnecessary herein and it is intended to merely emphasize that the chain lock forming the invention is preferably employed with an exceptionally secure form of dead bolt door lock although it may be employed in a generally similar way with other types of door locks including common door locks having knobs on one or both sides of the door.

FIG. 5 shows a modification of the invention wherein all parts of the improved safety chain lock are identical to those already shown and described, FIGS. 1 to 4, except for the arrangement of the chain end anchor means 13 14 which is dispensed with in the modification. Instead thereof, the previously-described anchor retainer 17 on the interior of the door frame 11 receives in its back recess 15 an anchor plate 57 of a block-like lock body 58 which projects inwardly of the door frame 11 and retainer 17 in lieu of the previously-described anchor 13–14. The lock body 58 has a key operable rotatable tumbler cylinder or plug 59 exposed on one vertical side thereof nearest the free edge of the door 10. Upon use of a proper key at the interior of the door, a locking tooth, not shown, within the lock body 58 is retracted from its normal locking position in a bore 60 of the lock body to release a locking pin 61 carried by one end of a flexible locking chain 62, whose opposite end, not shown in FIG. 5, is secured to the retainer plate 31 or to an equivalent retainer means on the swinging door. That is to say, the embodiment of FIG. 5 may be employed with the identical retainer 31 previously described or with a similar retainer whose slot 30 is closed or with some modified retainer securely attached to the door. The lock pin 61 has a groove 63 near its tip to receive the spring urged locking tooth, not shown, in the lock body 58 prior to release by use of a key. The tumbler lock mechanism of the lock body 58 is conventional. Thus the embodiment of FIG. 5 has the attributes of the previous preferred embodiment and additionally requires the use of a key to release one end of the chain whose opposite end may be permanently secured to retainer 31 or an equivalent retainer.

It is to be understood that the forms of the invention herewith shown and described are to be taken as preferred examples of the same, and that various changes in the shape, size and arrangement of parts may be resorted to, without departing from the spirit of the invention or scope of the subjoined claims.

I claim:

1. A safety chain lock for doors comprising a flexible safety element, a first anchor carried by one end of said element, a first retainer for the first anchor and being substantially right angular and adapted for attachment to the interior vertical edge of a door frame, a second anchor for the opposite end of said flexible safety element, and a second retainer for said second anchor adapted to engage the second anchor releasably, the second retainer having substantially right angular portions adapted to extend about the interior vertical edge of a door and to be attached thereto, and a plate extension on said second retainer adapted to lie on the interior face of a door and to be immovably anchored to an adjacent door lock assembly, said flexible safety element comprising a length of chain, said first anchor coupled to one end link of said chain, said second anchor coupled to the opposite end chain link and having a shank, said second retainer having a slot receiving said shank lockingly and separably, said slot being substantially horizontal and being formed in a wall portion of the second retainer which is offset inwardly from a door on which the chain lock is mounted, a short right angular connecting web on the second retainer extending between said offset wall portion and said plate extension, and one end of said slot opening through said short right angular connecting web.

2. A safety chain lock for doors comprising a flexible safety element, first and second anchors carried by opposite ends of the flexible safety element, the first anchor having a base plate rigid therewith, a substantially L-shaped retainer for the first anchor adapted for attachment to two right angular faces of a door frame and extending around an interior corner of a door frame, said L-shaped retainer for the first anchor adapted to overlie said base plate of the first anchor for clamping the base plate against the door frame and having an opening through which the first anchor projects inwardly, and a retainer for said second anchor including a right angular portion adapted for attachment to the swinging edge of a door, and the retainer for the second anchor including a slotted portion offset from the interior side of the door and adapted to receive the second anchor lockingly and releasably.

3. A safety chain lock for doors as defined in claim 2, and a plate extension on said slotted offset portion adapted to be fixedly secured to a door lock assembly on the interior side of the door.

4. A safety chain lock for doors as defined in claim 3, and said plate extension formed as a ring element adapted to fit over a sleeve portion of a door lock housing assembly and to be held beneath a lock cylinder housing on the interior side of the door.

* * * * *